US011252525B2

(12) United States Patent
Lorho et al.

(10) Patent No.: US 11,252,525 B2
(45) Date of Patent: Feb. 15, 2022

(54) COMPRESSING SPATIAL ACOUSTIC TRANSFER FUNCTIONS

(71) Applicant: Apple Inc., Cupertino, CA (US)

(72) Inventors: Gaetan R. Lorho, Redwood City, CA (US); Jonathan D. Sheaffer, San Jose, CA (US); Symeon Delikaris Manias, Los Angeles, CA (US); Frank Baumgarte, Sunnyvale, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/128,910

(22) Filed: Dec. 21, 2020

(65) Prior Publication Data

US 2021/0211821 A1 Jul. 8, 2021

Related U.S. Application Data

(60) Provisional application No. 62/958,171, filed on Jan. 7, 2020.

(51) Int. Cl.

| | |
|---|---|
| ***H04S 7/00*** | (2006.01) |
| ***H04R 1/40*** | (2006.01) |
| ***H04R 3/00*** | (2006.01) |
| ***H04R 3/04*** | (2006.01) |
| ***H04R 29/00*** | (2006.01) |
| ***H04R 5/027*** | (2006.01) |

(52) U.S. Cl.

CPC ..... *H04S 7/30* (2013.01); *H04R 1/406* (2013.01); *H04R 3/005* (2013.01); *H04R 3/04* (2013.01); *H04R 5/027* (2013.01); *H04R 29/005* (2013.01); *H04S 2400/15* (2013.01); *H04S 2420/01* (2013.01)

(58) Field of Classification Search

CPC .... H04S 7/30; H04S 2400/15; H04S 2420/01; H04R 1/406; H04R 3/005; H04R 3/04; H04R 5/027; H04R 29/005

USPC ..... 381/91, 92, 124

See application file for complete search history.

(56) References Cited

U.S. PATENT DOCUMENTS

| | | | | |
|---|---|---|---|---|
| 10,764,684 | B1 * | 9/2020 | Sheaffer | H04R 1/406 |
| 2013/0156222 | A1 * | 6/2013 | Lee | H04R 3/005 381/93 |
| 2019/0069083 | A1 * | 2/2019 | Salehin | H04R 3/005 |

(Continued)

FOREIGN PATENT DOCUMENTS

WO WO-2018053050 A1 * 3/2018

OTHER PUBLICATIONS

Harshman, Richard A., et al., "Shifted factor analysis—Part I: Models and properties", Jounal of Chemometrics, J. Chemometrics 2003; 17; pp. 363-378.

(Continued)

*Primary Examiner* — William A Jerez Lora

(74) *Attorney, Agent, or Firm* — Womble Bond Dickinson (US) LLP

(57) ABSTRACT

Transfer functions can describe responses of microphones or ears to sounds at different locations on a sphere. The transfer functions can be compressed by determining, based on transfer functions, a) one or more basis transfer functions, and b) spherical harmonics coefficients that describe variations of the transfer functions with respect to spherical coordinates. Other aspects are described and claimed.

25 Claims, 8 Drawing Sheets

(56) References Cited

U.S. PATENT DOCUMENTS

2019/0246203 A1* 8/2019 Elko ..... H04R 3/005

OTHER PUBLICATIONS

Hong, et al., "Shifted factor analysis—Part II: Algorithms", Journal of Chemometrics, J. Chemometrics 2003; 17; pp. 379-388.
Morup, Morten, et al., "Shifted Independent Components Analysis", 7th International Conference on Independent Component Analysis and Signal Separation, 2007, 8 pages.
Brett, Lindy, "Methods of Spherical Harmonic Analysis", Q. JI. R. astr. Soc., 1988, vol. 29, pp. 129-155.

* cited by examiner

Spherical Harmonic Coefficients (Order 2; M=4):

| | | | |
|---|---|---|---|
| -0.2164 | -0.0756 | 0.4304 | -0.1903 |
| -40.4825 | -1.1333 | 0.7089 | -40.5106 |
| -6.6999 | 4.3322 | -1.1473 | 1.2120 |
| 1.0696 | 4.5470 | -1.2547 | 1.1532 |
| 0.0442 | 0.7614 | -0.8096 | 0.0181 |
| 0.1925 | -0.2913 | -0.0515 | -0.0101 |
| -0.3256 | 0.6906 | 0.4259 | -0.3464 |
| -0.0022 | -0.3924 | 0.0186 | 0.0128 |
| 0.2602 | 0.8162 | 0.3248 | 0.2645 |

COMPRESSING SPATIAL ACOUSTIC TRANSFER FUNCTIONS

CROSS-REFERENCE TO RELATED APPLICATIONS

This application claims priority to U.S. provisional application No. 62/958,171 filed Jan. 7, 2020, the entirety of which is incorporated herein by reference.

FIELD

One aspect of the disclosure relates to compression of spatial acoustic transfer functions.

BACKGROUND

Audio capture devices such as microphones or devices with microphones can sense sounds by converting changes in sound pressure to an electrical signal with an electro-acoustic transducer. Transfer functions can describe and characterize a response of a microphone to different sounds at different locations.

SUMMARY

Spatial transfer functions describe the response of a microphone to an acoustic sound source. Spatial transfer functions are crucial to filter design for spatial audio applications. They provide information about a) sensitivity of microphones in a product to many incident directions in space and/or b) of spatial propagation patterns of a loudspeaker product. Various applications such as spatial capture, beamforming, sound field synthesis, binaural rending, and so on, rely on a-priori knowledge of such transfer functions. Metadata of an audio recording can include spatial transfer functions associated with the microphones of the recording device. Other metadata useful for a playback device can include spatial transfer functions of the device's loudspeakers.

It is desirable to produce a compact representation of such transfer functions. In some cases, for example, filters are to be designed on the fly (e.g., in real-time). A compact representation (e.g., compression) of the transfer functions can more efficiently be communicated over a network, or embedded into a media file without placing a burden on device memory and storage.

In one aspect of the present disclosure, a method is described that compresses and compactly represents spatial transfer functions. Shifted component modeling/analysis (SCM), in combination with spherical harmonics analysis/truncation (SHT), can achieve lossy compression ratios greater than 1:250 while preserving 99% of the variation in the data. Such compression appears to be generally appropriate for spatial audio applications. In some aspects, impulse responses can be processed by the method as input, thus the method can be performed with a time-domain representation of the spatial transfer functions.

In one aspect, a method for compressing transfer functions includes: determining original transfer functions of microphones of a system, wherein each of the original transfer functions is associated with a response of one of the microphones to a sound at a location on a sphere; and determining, based on the original transfer functions, a) one or more basis transfer functions, and b) spherical harmonics coefficients that describe time and amplitude variations of the original transfer functions with respect to spherical coordinates.

In another aspect, a method for compressing transfer functions includes: determining original transfer functions of a sound radiating device (e.g., loudspeakers) of a system, wherein each of the original transfer functions is associated with a response of a microphones at a location on a sphere to a sound radiated by one of the loudspeakers; and determining, based on the original transfer functions, a) one or more basis transfer functions, and b) spherical harmonics coefficients that describe variations of the original transfer functions with respect to spherical coordinates.

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the Claims section. Such combinations may have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Several aspects of the disclosure with reference to the appended drawings are now explained. Whenever the shapes, relative positions and other aspects of the parts described are not explicitly defined, the scope of the invention is not limited only to the parts shown, which are meant merely for the purpose of illustration. Also, while numerous details are set forth, it is understood that some aspects of the disclosure may be practiced without these details. In other instances, well-known circuits, algorithms, structures, and techniques have not been shown in detail so as not to obscure the understanding of this description.

Figure 1:
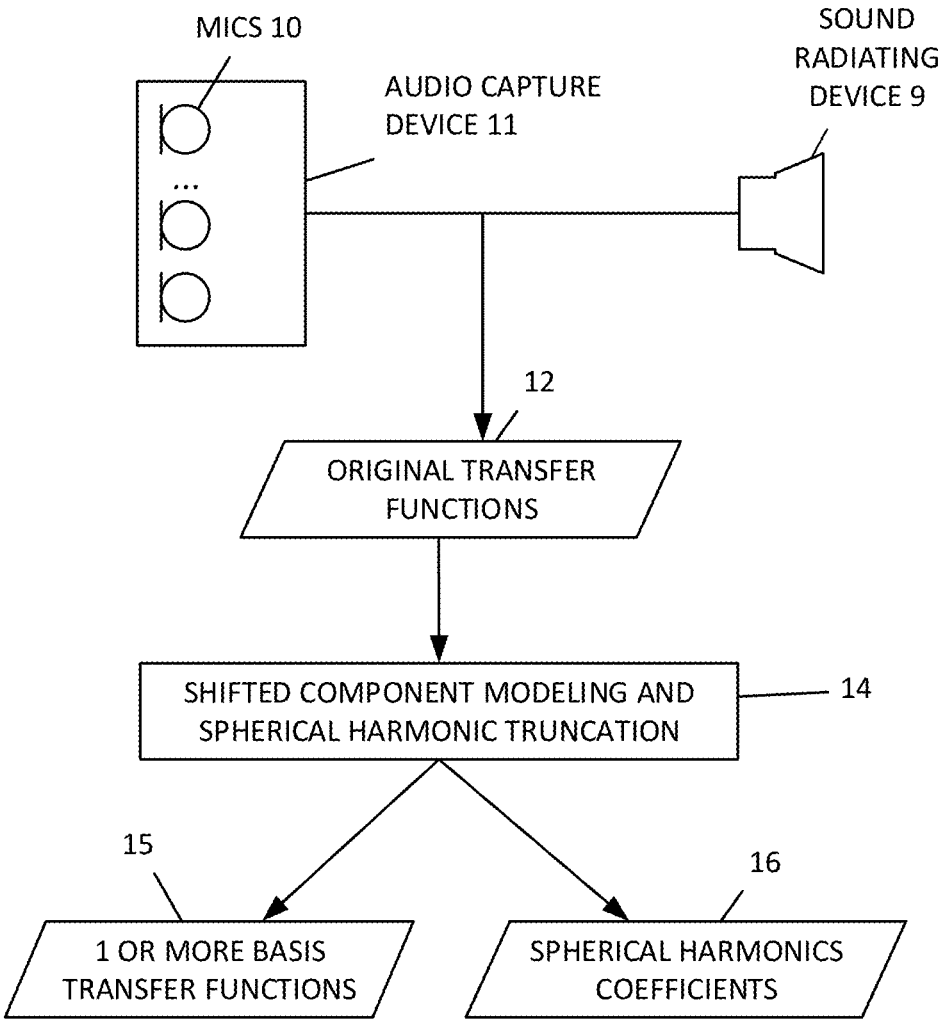
FIG. 1 illustrates a method of compressing transfer functions, according to one aspect.

Compressing Transfer Functions with Component Modeling and Spherical Harmonics Analysis Referring to FIG. 1, in one aspect, a device 11 can have microphones 10. The microphones can have fixed locations forming one or more microphone arrays. Original transfer functions 12 can be determined for each microphone, where each transfer function describes a (time) response of the microphone to a sound at a location (e.g., a direction and distance) relative to the microphone. In one aspect, the transfer functions describe responses to sounds located on an imaginary grid having a spherical geometry. The transfer functions can be determined through tests and/or simulation, with known techniques. Based on the original transfer functions (e.g., by performing SCM and SHA at block 14), a system or process can determine a) one or more basis transfer functions, and b) spherical harmonics coefficients that describe time and amplitude variations of the original transfer functions with respect to spherical coordinates.

In one aspect, the device 11 can have a sound radiating device 9 (e.g., a loudspeaker or a plurality of loudspeakers). The loudspeakers can have fixed locations, forming one or more loudspeaker arrays. Original transfer functions 12 can be determined for each loudspeaker, where each transfer function describes a response of a microphone at a known location (e.g., a direction and distance) relative to a sound from the sound radiating device. In one aspect, the transfer functions describe responses to sounds with microphones located on an imaginary grid having a spherical geometry. The transfer functions can be determined and described as stated in other sections. The following description is based on transfer functions derived from capture devices with microphones. However, the same description equally applies to transfer functions derived from sound radiating devices with loudspeakers.

In one aspect, the compressed transfer functions can be formatted as M×Q×S×R where M is a number of entities (e.g., microphones or ears), Q is a direction (e.g., an azimuth and an elevation), S is a transfer function, and R is a distance. In such a case, Q and R can provide coordinates on a sphere having R radius. The number of sound sources (different Q coordinates) can be dependent on application, ranging from less than ten to several thousands of sound sources and distinct coordinates on a sphere.

Consider a dataset comprising N spatial transfer functions for M entities, for example microphones or ears. In one aspect of the present disclosure, a general form of a data compression method includes two steps. Ina first step, SCM, which is a dimension-reduction method (described in detail below), can be performed on a set of transfer functions. A component p represents the largest variation in the dataset with a limited number, P, of 'basis' transfer functions. For each component p, a time shift and a weight specific to each spatial direction and entity (size N×M) can be determined.

In a second step, SHT allows a compressed/compact representation of the sets of time shifts and spatial weights for each p (component) and m (entity). The time shifts and spatial weights can be represented as spherical harmonics coefficients that are a function of the N spatial directions. SH analysis and truncation involves calculating the coefficients of a truncated series of surface spherical harmonic functions. The calculation of the coefficients can be carried out through known methods, e.g., through least squares and adaptations of least squares or spherical harmonic coefficients can be obtained by matrix projection in the case of a regular spatial sampling scheme.

Shifted Component Modeling (SCM) includes Shifted Factor Analysis (see, e.g., Harshman et al., 2003) and Shifted Independent Component Analysis (see, e.g., Mørup et al., 2007). The former method offers a discrete representation of shifts (in time samples), whereas SICA achieves a continuous representation of time shifts by modeling shifts in the frequency domain. It should be understood that different component modeling approaches can be selected depending on the complexity of the data and the intended model compactness. SCM represents time responses with one or several basis functions as found in usual dimension-reduction methods but adds a set of time shifts per basis function to better model the variations between time responses. The original transfer functions can therefore be represented by basis transfer functions, time shifts, and spatial weights. In other words, the original transfer functions can be reconstructed, to a substantial degree, with the basis transfer functions, time shifts and spatial weights.

A 1-component shifted component model can generate time shifts and spatial weights of the transfer functions. A low-order SHT of the time shifts and spatial weights can be applied to produce the highest data compression. A SHT of the time shifts resulting from a 1-component SCM can, in one aspect, be employed to align the dataset of spatial transfer functions before modeling it with a conventional principal component analysis (PCA). Similar P 'basis' transfer functions can be generated for each component p. A weight specific to each spatial direction and entity (size N×M) are produced, which can subsequently subject to SHT with optimal order selection for each component and entity. Increasing the number of basis transfer functions with this approach can produce improved models, e.g., explaining 99% or more of variance of the transfer functions. Other modeling methods exist to identify latent variables as basis functions, in addition to PCA.

For difficult datasets, e.g., microphone arrays with complex interference patterns of HRTFs, a 1-component SCM followed by a low-order SHT of time shifts and spatial weights can be applied as a baseline model, which can then be augmented by one or several (SCM-SHT related) sub-models limited to spatial areas where the baseline model is insufficient.

Figure 10:
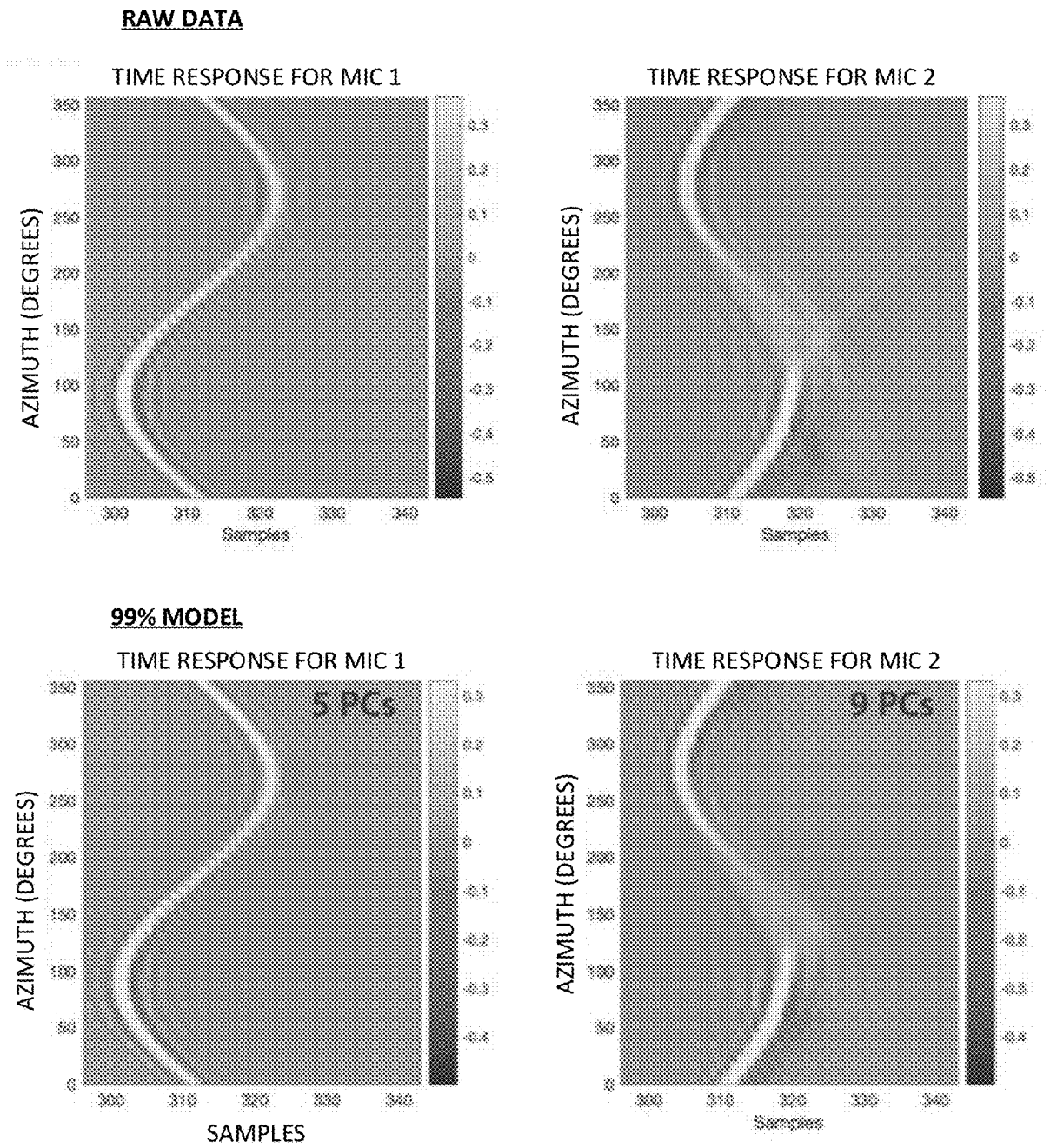
FIG. 10 illustrates the compressed model's performance, according to one aspect.

The method can compress and compactly represent spatial transfer function, achieving lossy compression ratios greater than 1:250 while preserving 99% of the variation in the data. This has been shown to be generally appropriate for spatial audio applications. See, for example, FIG. 10 showing raw data for impulse responses of a microphone, and a 99% compressed model being able to substantially replicate the original impulse responses.

General Model

Figure 2:
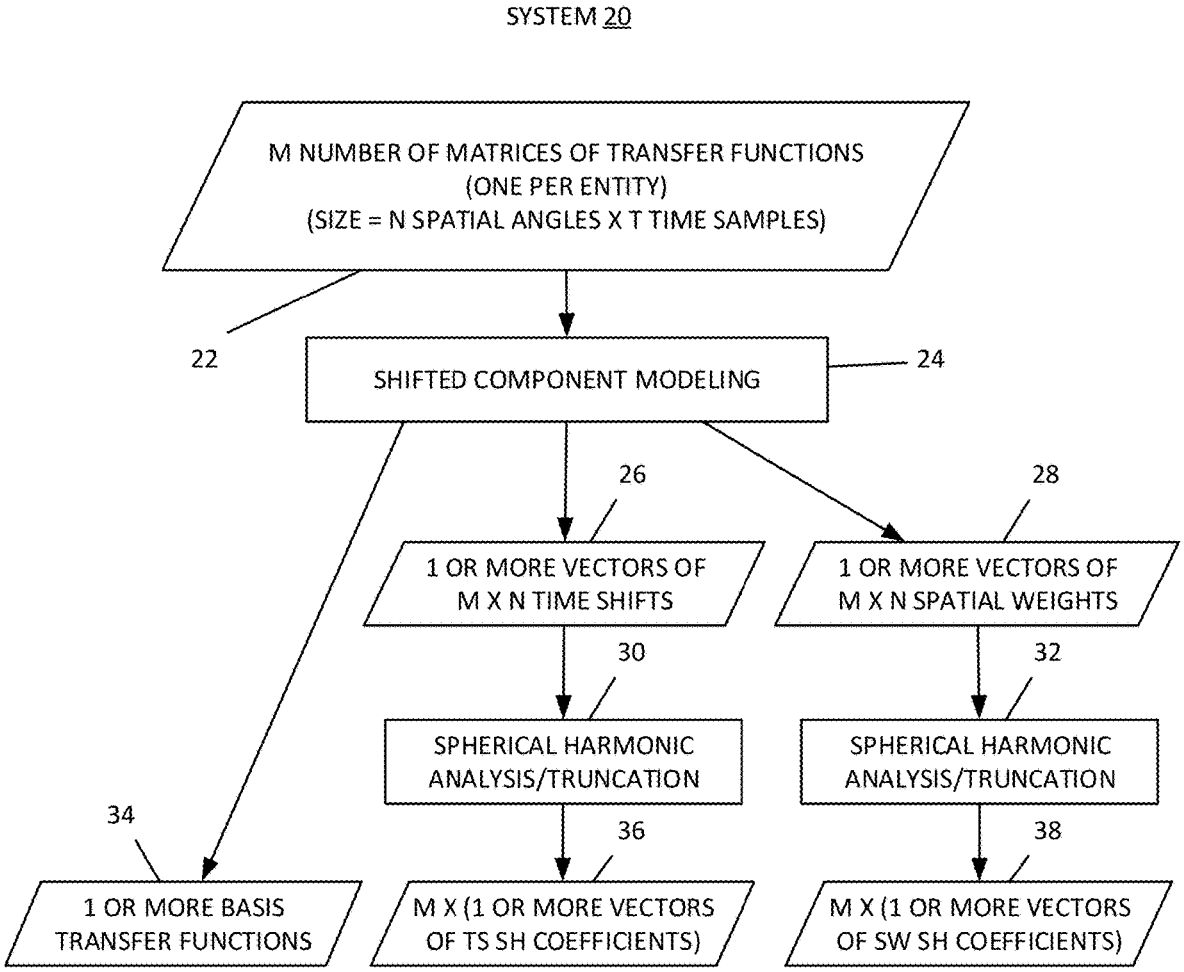
FIG. 2 illustrates a method of compressing transfer functions, according to one aspect.

Referring now to FIG. 2, a process performed by a system 20 is shown that compresses transfer functions, according to one aspect. The process includes determining original transfer functions of entities (e.g., a microphone or an ear), wherein each of the original transfer functions is associated with a response of the entity to a sound. The sound source can be located on an imaginary sphere that surrounds the entity. The process can include determining, based on the original transfer functions, a) one or more basis transfer functions, b) for each of the entities, a set (e.g., a vector) of time shifts that includes a time shift for each location on the sphere, the time shifts representing temporal differences between the original transfer functions, and c) for each of the entities, a set (e.g., a vector) of spatial weights that includes a spatial weight for each location on the sphere. The process can further include compressing the sets of time shifts and sets of spatial weights (e.g., through SHT) by determining spherical harmonics coefficients that associate variations of the original transfer functions to coordinates on the sphere. In one aspect, for each basis transfer function one set of time shifts and one set of spatial weights is determined. These sets are applied at SHT, as discussed in further below.

In one aspect, the original transfer functions can be represented by block 22 showing M number of matrices of transfer functions. M can represent the number of sound receiving entities (e.g., ears or microphones). Each matrix can have N spatial angles (e.g., an azimuth and/or elevation) that indicate a location of a sound on a sphere, and T time samples. Accordingly, the original transfer functions are provided for each of the microphones for each location on a sphere (provided by a spatial angle and distance/radius) having T time samples.

Figure 8:
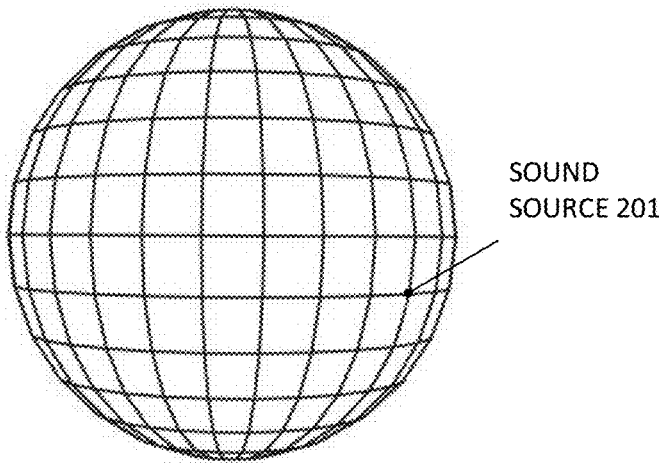
FIGS. 8-9 show spatial locations and coordinates, according to one aspect.
Figure 9:
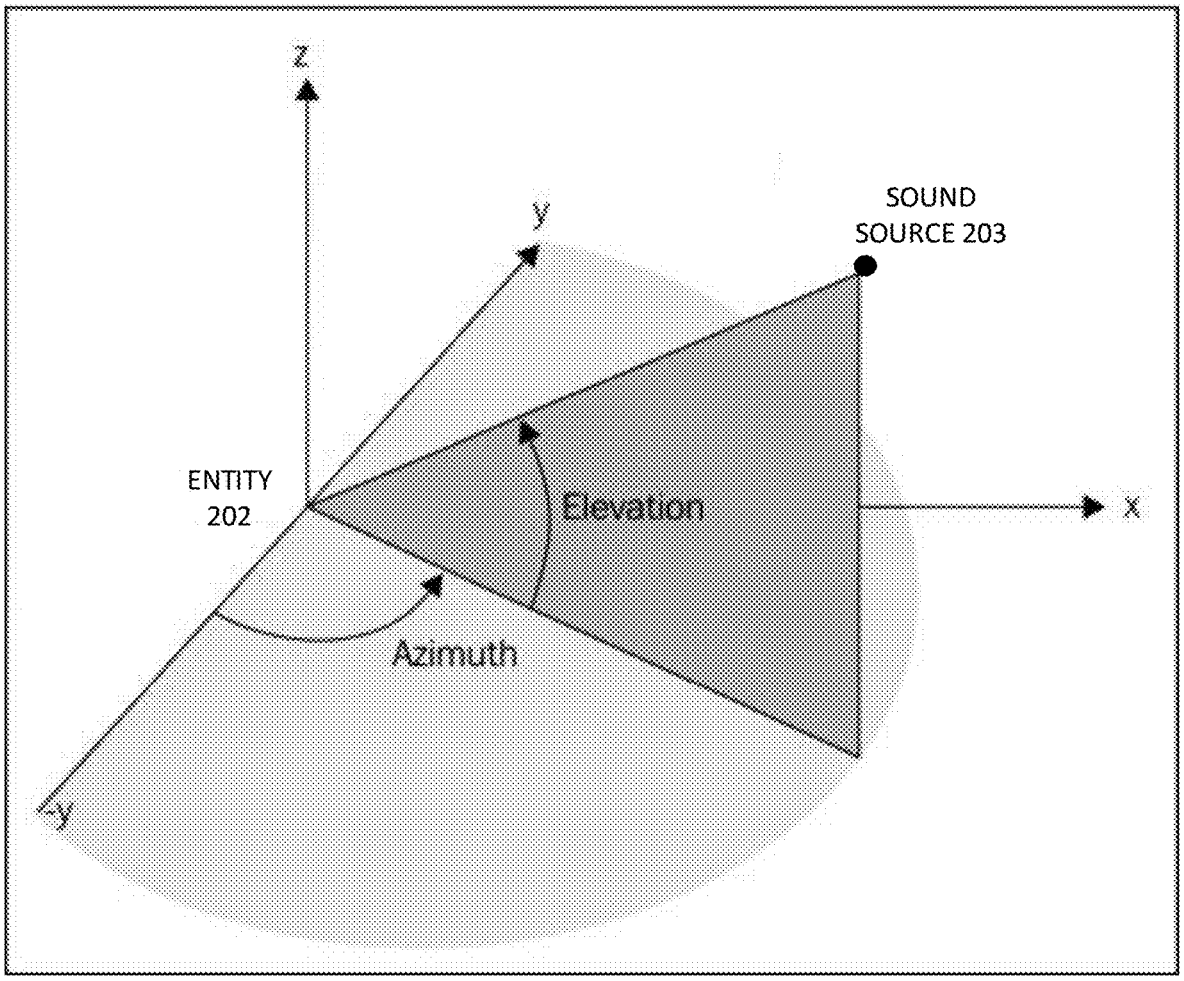

For example, referring briefly to FIGS. 8 and 9, each of the transfer functions can be associated with an entity's response to a sound source 201 located on a sphere. A recording device having M microphones can be imagined to be located within the sphere. It should be understood that, although not shown, the spherical grid shown in FIG. 8 can have a sound source at each intersecting line. The amount of sound sources (or the density of the grid) can be determined based on application, e.g., how much spatial resolution is desired. To further illustrate mapping of spherical coordinates according to one aspect, FIG. 9 shows an entity 202, which can represent an ear or microphone, in relation to a sound source 203. A position of a sound source relative to the entity (or device), can be determined as a direction (e.g., azimuth and elevation) on a sphere (radius). The number T of time samples of the transfer function can similarly vary based on application.

Referring back to FIG. 2, SCM 24 can be applied to the original transfer functions to determine one or more basis transfer functions 34, one or more time shift vectors 26, and one or more spatial weights 28. An SCM operation can include modeling a time shift of transfer functions and performing component analysis (e.g., based on one or more components) to determine a variation of the transfer functions with respect to each component.

Figure 4:
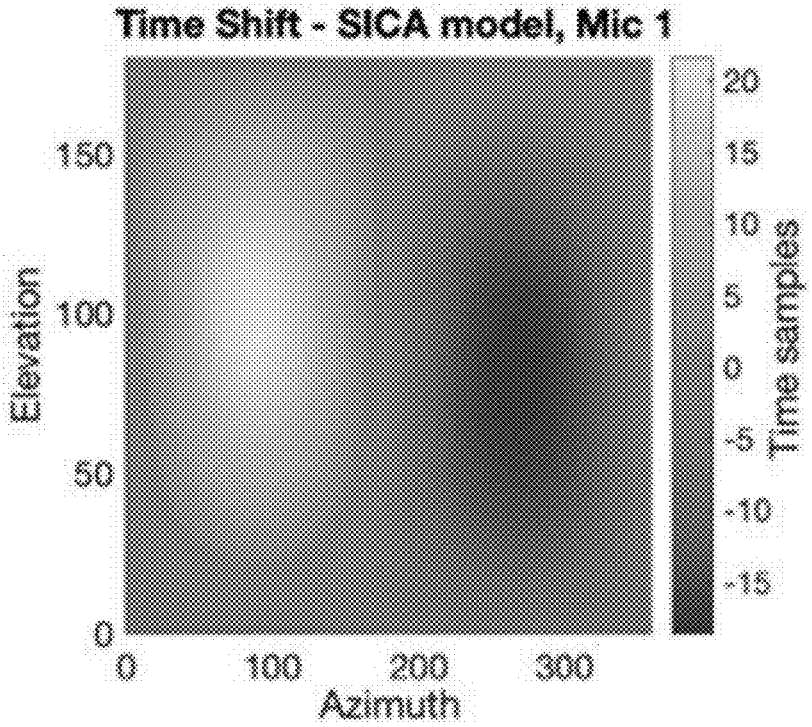
FIGS. 4-5 show time shifts and spatial weights of transfer functions varying over a sphere.
Figure 5:
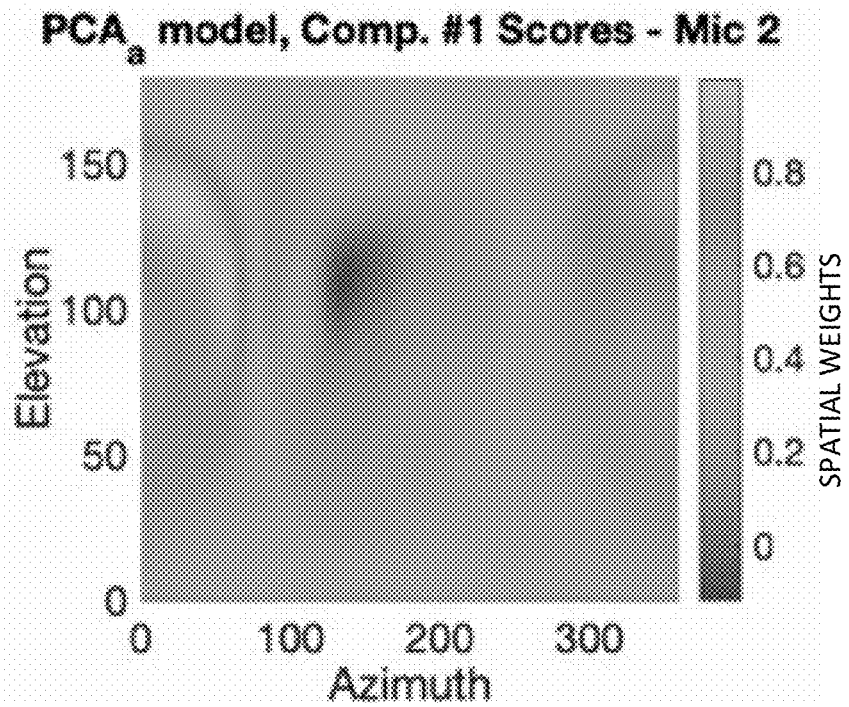

Block 24 can reduce dimensions of a dataset (e.g., M number of matrices, each matrix having N spatial angles×T time samples) to basis transfer functions and vectors having M×N time shifts and coefficients. The time shifts and spatial weights of the transfer functions can vary over different directions and location. For example, as shown in FIG. 4, a high positive time shift (20 samples) is shown at approximately 90 degrees (Azimuth) and 100 degrees (Elevation) while a high negative time shift is shown at 280 and 75. Similarly, as shown in FIG. 5, spatial weights are shown to be low at 120 degrees and 110 degrees, but higher at other spherical coordinates.

SHT operations can be applied at blocks 30 and 32 to the resulting time shift vectors (e.g., sets of time shifts) and spatial weight vectors (e.g., sets of spatial weights) for compression. SHT block 30 can compress the one or more vectors of M×N time shifts to M×one or more vectors of time shift spherical harmonics coefficients. The time shift spherical harmonics coefficients, determined for each entity, can describe variation of the time shifts relative to coordinates on a sphere. These coefficients are compressed representation of the M×N spatial weights.

Figures 6, 7:
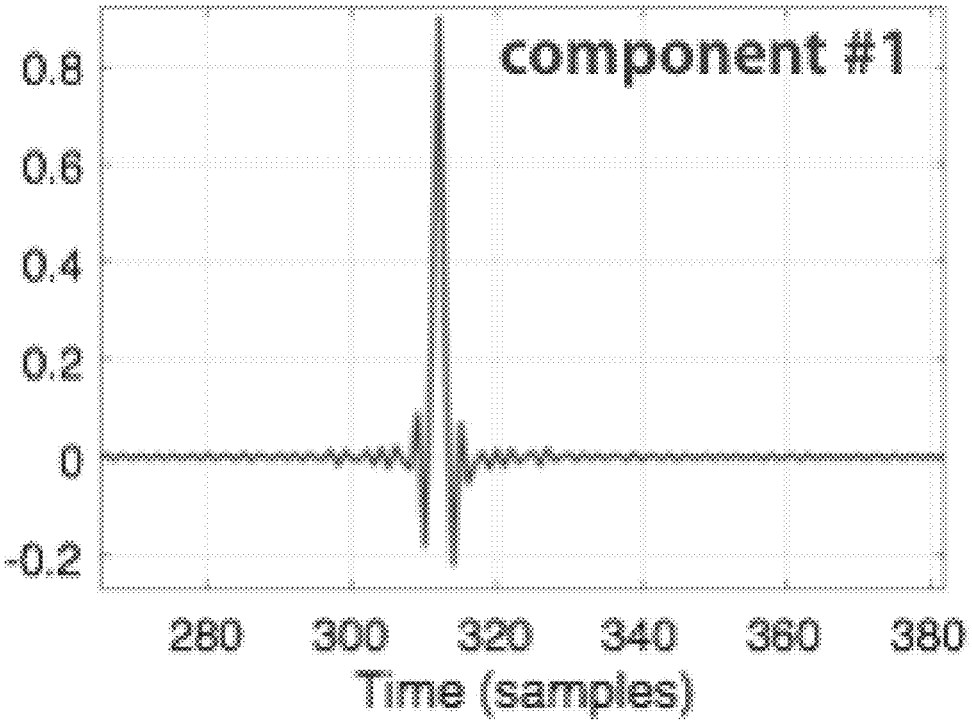
FIG. 6 shows a table of spherical harmonics coefficients, according to one aspect.
FIG. 7 shows a basis transfer function, according to one aspect.

Similarly, the SHT block 32 can compress the one or more vectors of M×N spatial weights to M×one or more vectors of spatial weight spherical harmonics coefficients. The spatial weight spherical harmonics coefficients, determined for each entity, can describe variation of the spatial weights relative to coordinates on a sphere. These coefficients are compressed representations of the M×N spatial weights. An example of time shift spherical harmonics coefficients having an order 2 is shown in FIG. 6.

The M matrices of transfer functions having size N spatial angles×T time samples can be compressed to one or more basis transfer functions 34. Thus, a relatively small number of basis transfer functions can describe a much larger number of original transfer functions, by using time shift spherical harmonics coefficients and spatial weight spherical harmonics coefficients to translate from the basis transfer functions to the original transfer functions. An example of a basis transfer function with respect to, or projected onto, component 1 is shown in FIG. 7.

In one aspect, it can be beneficial to additionally recalculate a subset of the time shifts and spatial weights for some areas of the sphere (e.g., through shifted component modeling and analysis), and recompress the recalculated subset of time shifts and spatial weights (e.g., with SHT) for areas on the sphere where previous calculations are deemed insufficient or lack accuracy or resolution in representing the original impulse responses. For example, microphones of a device can have a complex interference pattern of HRTFs that introduce complexity at some sound positions. This can result in asymmetrical and/or disproportionate variations in the impulse responses relative to spherical coordinates (see, e.g., FIG. 4 and FIG. 5, certain areas of the sphere have higher time shift variation and spatial weight variation than others).

Two-Step Model

Figure 3:
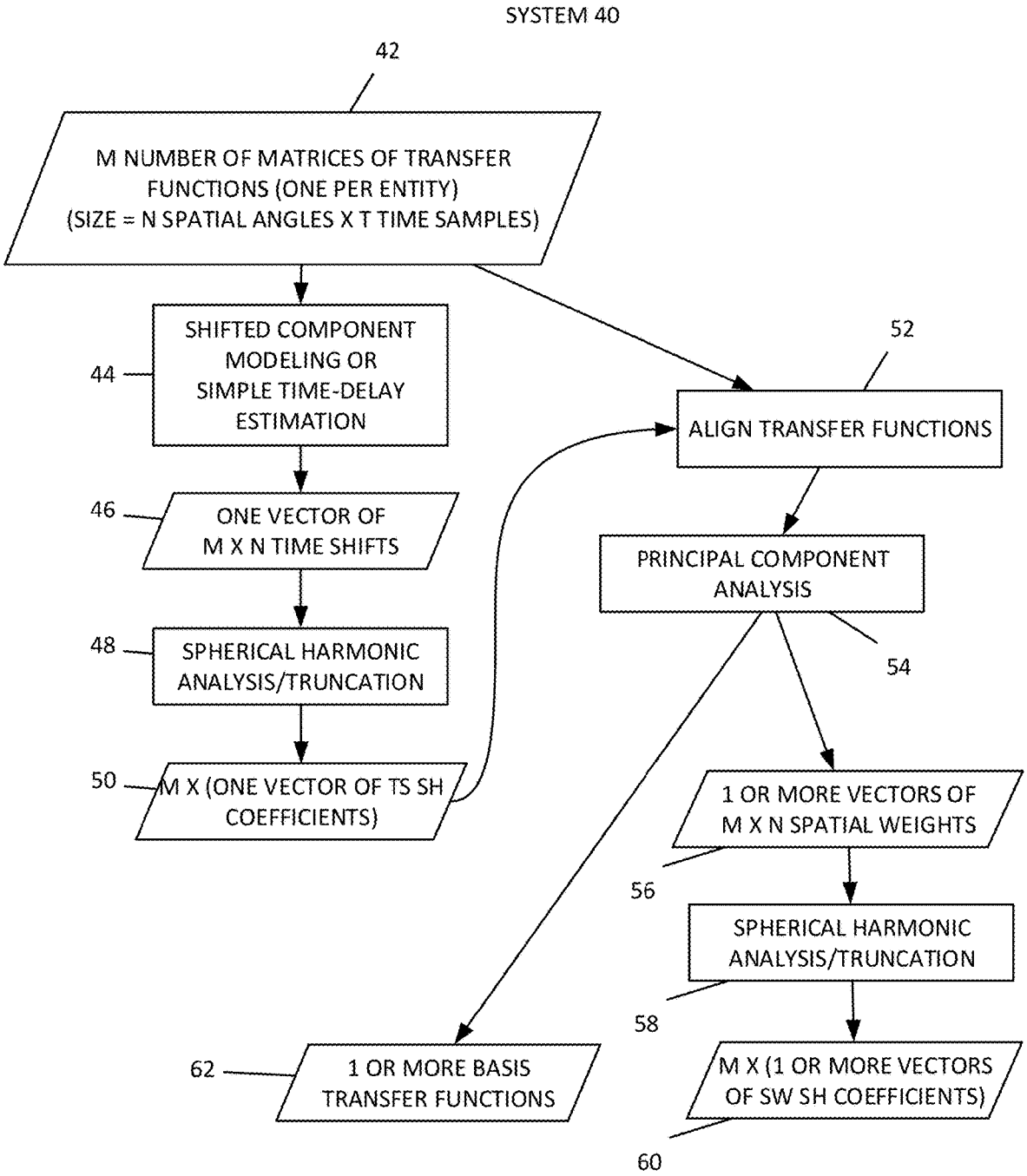
FIG. 3 illustrates a method of compressing transfer functions, according to one aspect.

Referring now to FIG. 3, a process performed by a system 40 is shown that compresses transfer functions, according to one aspect. The process includes determining original transfer functions of microphones of a system, wherein each of the original transfer functions is associated with a response of one of the microphones to a sound at a location on a sphere, aligning the original transfer functions in time; and determining, based on resulting aligned original transfer functions, one or more basis transfer functions and coefficients that associate amplitude variations of the aligned original transfer functions to coordinates on the sphere. The two-step model shown in FIG. 3 is an algorithmically simpler approach to compression of transfer functions. This model includes only one set of time shifts derived from SCM (or by a simple time-delay estimation) in step 1, while step 2 produces the set(s) of spatial weights.

At block 42 M transfer functions can be determined having N spatial angles and T time samples. M can represent a number of microphones of a capture device (e.g., a smart phone, a laptop computer, a tablet computer, a camera, a smart speaker, a headworn device such as a headphone set, a head mounted display, or other device with a plurality of microphones capable of audio capture. The original transfer functions and data sets representing the transfer functions can be calculated through modeling and simulation and/or by measurement (e.g., of an impulse response).

The original transfer functions can be aligned (e.g., time synchronized) by determining, based on the original transfer functions, for each entity, a set of time shifts that includes a time shift for each location on the sphere, where the set of time shifts representing temporal variations between the original transfer functions. In some aspects, a one-component SCM can be applied to estimate time shifts. In other aspects, a simple time-delay estimation can be applied, e.g., a group-delay. At block 44, shifted component modeling can be applied to the transfer functions, resulting in 1 vector of M×N time shifts 46. The time shifts can define the temporal differences between the transfer functions of an entity relative to different sound sources.

Next, based on the sets of time shifts, a set of time shift spherical harmonics coefficients can be determined for each of the entities, where the coefficients describe a variation of the time shifts relative to coordinates on the sphere. The original transfer functions of the entities can be aligned with the set of time shift spherical harmonics coefficients, for each of the microphones. For example, the time shifts can be compressed by applying SHT 48 on the one vector of M×N time shifts. The result, here, is a compressed collection of M×one vector of time shift spherical harmonics coefficients. These time shift spherical harmonics coefficients can be used to align the original transfer functions (e.g. aligning M matrices of transfer functions, each matrix having N spatial angles at T time samples) at block 52.

Based on the aligned original transfer functions, the system can determine a) one or more basis transfer functions, and b) a set of spatial weights for each location on the sphere for each of the microphones. The spatial weights can be compressed and expressed as a set of spatial coefficients for each of the microphones, the coefficients describing a variation of the spatial weights relative to coordinates on the sphere. For example, principal component analysis 54 can be applied to the aligned transfer functions (aligned at block 52) to determine one or more vectors of M×N spatial weights 56 and one or more basis transfer functions 62. In one aspect, the component analysis is principal component analysis and a component is determined that represents and indicates the largest variation in the aligned original transfer functions when projected on the component.

SHT 58 can be applied to the one or more vectors of M×N spatial weights. The spatial weights can thus be represented in compressed form as one or more vectors of spatial weights coefficients 60 for each entity M, the coefficients modeling a variation of the spatial weights relative to coordinates on the sphere.

Audio File Metadata, Streaming, Decoding and Playback

In one aspect, the one or more basis transfer functions, and the spherical harmonics coefficients (e.g., the sets of time shift coefficients, and/or the sets of spatial weight coefficients) are encoded as metadata in an audio file with audio data that was recorded with the device that are described by the basis transfer functions and spherical harmonics coefficients. Additionally or alternatively, the metadata can be associated with recorded audio and/or a recording device. Different recording devices (e.g., different smart phone models, tablet computers, speakers, cameras, etc.) can each be characterized acoustically with corresponding basis transfer functions and spherical harmonics coefficients.

In one aspect, the one or more basis transfer functions, and the spherical harmonics coefficients can be communicated over a network as a bitstream to a playback or decoding device on the network. The metadata describes characteristics of the recording device, and thus, can be useful in processing any audio that is recorded by the same (or substantially similar) recording device.

In one aspect, a playback and/or decoding device can use the basis transfer functions and spherical harmonics coefficients to produce filters to be applied to the audio recording, e.g., for beamforming, spatial rendering, and/or voice activity detection. Other audio processing can also utilize the compressed transfer function data. In one aspect, the playback device produces filters dynamically (e.g., concurrent to when audio data is received and requested to be played).

Figure 11:
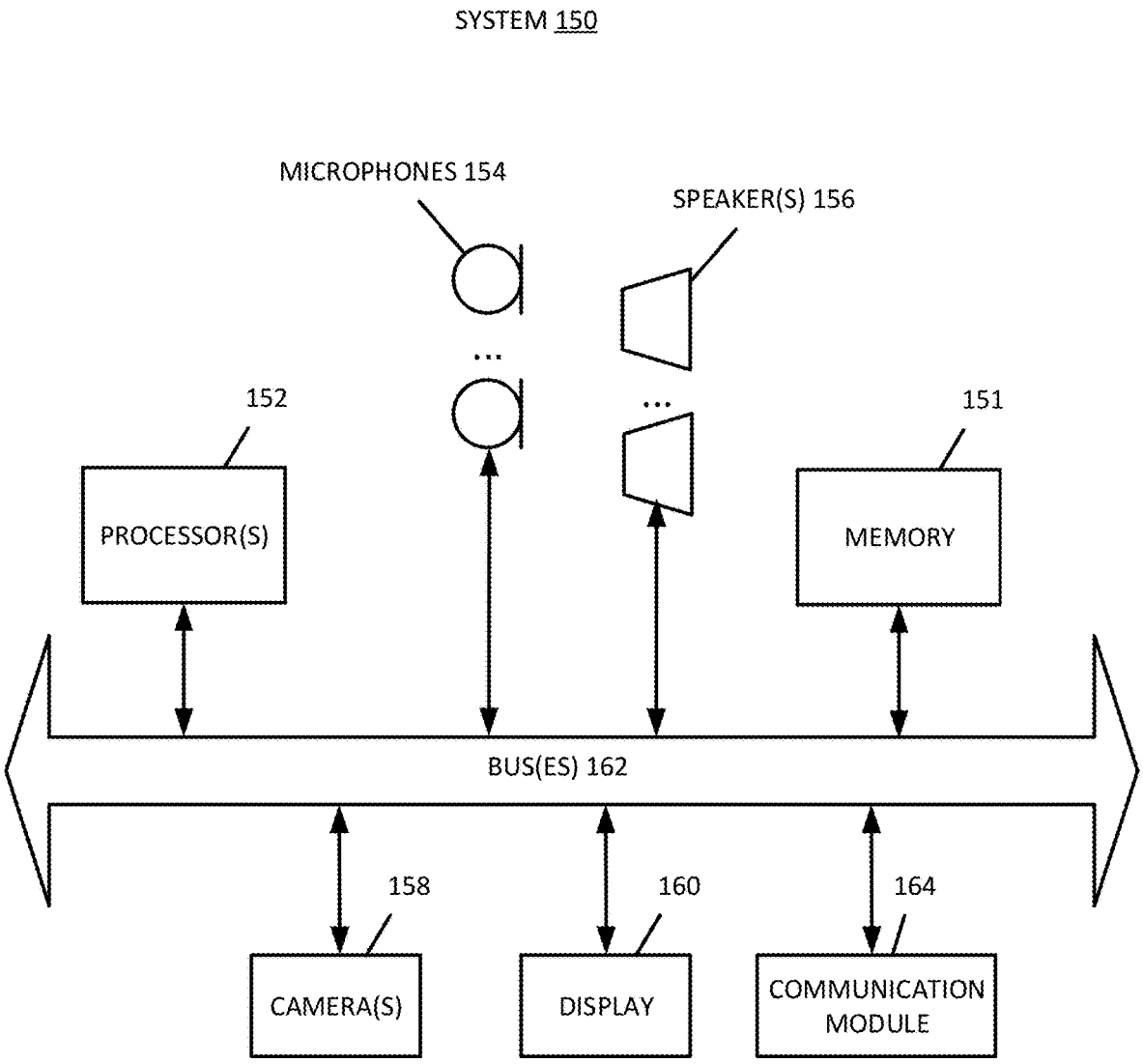
FIG. 11 shows a processing system, according to one aspect.

FIG. 11 shows a block diagram of audio processing system hardware (e.g., an encoding system or a playback/decoding system), in one aspect, which may be used with any of the aspects described. Note that while FIG. 11 illustrates the various components of an audio processing system that may be incorporated into smartphones, headphones, speaker systems, microphone arrays and entertainment systems, it is merely one example of a particular implementation and is merely to illustrate the types of components that may be present in the audio processing system. FIG. 11 is not intended to represent any particular architecture or manner of interconnecting the components as such details are not germane to the aspects herein. It will also be appreciated that other types of audio processing systems that have fewer components than shown or more components than shown in FIG. 11 can also be used. Accordingly, the processes described herein are not limited to use with the hardware and software of FIG. 11.

As shown in FIG. 11, the audio processing system 150 (for example, a laptop computer, a desktop computer, a mobile phone, a smart phone, a tablet computer, a smart speaker, a head mounted display (HMD), a headphone set, or an infotainment system for an automobile or other vehicle) includes one or more buses 162 that serve to interconnect the various components of the system. One or more processors 152 are coupled to bus 162 as is known in the art. The processor(s) may be microprocessors or special purpose processors, system on chip (SOC), a central processing unit, a graphics processing unit, a processor created through an Application Specific Integrated Circuit (ASIC), or combinations thereof. Memory 151 can include Read Only Memory (ROM), volatile memory, and non-volatile memory, or combinations thereof, coupled to the bus using techniques known in the art. In one aspect, a camera 158 and/or display 160 can be coupled to the bus.

Memory 151 can be connected to the bus and can include DRAM, a hard disk drive or a flash memory or a magnetic optical drive or magnetic memory or an optical drive or other types of memory systems that maintain data even after power is removed from the system. In one aspect, the processor 152 retrieves computer program instructions stored in a machine readable storage medium (memory) and executes those instructions to perform operations described herein.

Audio hardware, although not shown, can be coupled to the one or more buses 162 in order to receive audio signals to be processed and output by speakers 156. Audio hardware can include digital to analog and/or analog to digital converters. Audio hardware can also include audio amplifiers and filters. The audio hardware can also interface with microphones 154 (e.g., microphone arrays) to receive audio signals (whether analog or digital), digitize them if necessary, and communicate the signals to the bus 162.

Communication module 164 can communicate with remote devices and networks. For example, communication module 164 can communicate over known technologies such as Wi-Fi, 3G, 4G, 5G, Bluetooth, ZigBee, or other equivalent technologies. The communication module can include wired or wireless transmitters and receivers that can communicate (e.g., receive and transmit data) with networked devices such as servers (e.g., the cloud) and/or other devices such as remote speakers and remote microphones.

It will be appreciated that the aspects disclosed herein can utilize memory that is remote from the system, such as a network storage device which is coupled to the audio processing system through a network interface such as a modem or Ethernet interface. The buses 162 can be connected to each other through various bridges, controllers and/or adapters as is well known in the art. In one aspect, one or more network device(s) can be coupled to the bus 162. The network device(s) can be wired network devices (e.g., Ethernet) or wireless network devices (e.g., WI-FI, Bluetooth). In some aspects, various aspects described (e.g., simulation, analysis, estimation, modeling, object detection, etc.) can be performed by a networked server in communication with the capture device.

Various aspects described herein may be embodied, at least in part, in software. That is, the techniques may be carried out in an audio processing system in response to its processor executing a sequence of instructions contained in a storage medium, such as a non-transitory machine-readable storage medium (e.g. DRAM or flash memory). In various aspects, hardwired circuitry may be used in combination with software instructions to implement the techniques described herein. Thus the techniques are not limited to any specific combination of hardware circuitry and software, or to any particular source for the instructions executed by the audio processing system.

In the description, certain terminology is used to describe features of various aspects. For example, in certain situations, the terms "module", "encoder", "processor", "renderer", "combiner", "synthesizer", "mixer", "localizer", "spatializer", and "component," are representative of hardware and/or software configured to perform one or more processes or functions. For instance, examples of "hardware" include, but are not limited or restricted to an integrated circuit such as a processor (e.g., a digital signal processor, microprocessor, application specific integrated circuit, a microcontroller, etc.). Thus, different combinations of hardware and/or software can be implemented to perform the processes or functions described by the above terms, as understood by one skilled in the art. Of course, the hardware may be alternatively implemented as a finite state machine or even combinatorial logic. An example of "software" includes executable code in the form of an application, an applet, a routine or even a series of instructions. As mentioned above, the software may be stored in any type of machine-readable medium.

Some portions of the preceding detailed descriptions have been presented in terms of algorithms and symbolic representations of operations on data bits within a computer memory. These algorithmic descriptions and representations are the ways used by those skilled in the audio processing arts to most effectively convey the substance of their work to others skilled in the art. An algorithm is here, and generally, conceived to be a self-consistent sequence of operations leading to a desired result. The operations are those requiring physical manipulations of physical quantities. It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as those set forth in the claims below, refer to the action and processes of an audio processing system, or similar electronic device, that manipulates and transforms data represented as physical (electronic) quantities within the system's registers and memories into other data similarly represented as physical quantities within the system memories or registers or other such information storage, transmission or display devices.

The processes and blocks described herein are not limited to the specific examples described and are not limited to the specific orders used as examples herein. Rather, any of the processing blocks may be re-ordered, combined or removed, performed in parallel or in serial, as necessary, to achieve the results set forth above. The processing blocks associated with implementing the audio processing system may be performed by one or more programmable processors executing one or more computer programs stored on a non-transitory computer readable storage medium to perform the functions of the system. All or part of the audio processing system may be implemented as, special purpose logic circuitry (e.g., an FPGA (field-programmable gate array) and/or an ASIC (application-specific integrated circuit)). All or part of the audio system may be implemented using electronic hardware circuitry that include electronic devices such as, for example, at least one of a processor, a memory, a programmable logic device or a logic gate. Further, processes can be implemented in any combination hardware devices and software components.

While certain aspects have been described and shown in the accompanying drawings, it is to be understood that such aspects are merely illustrative of and not restrictive on the broad invention, and the invention is not limited to the specific constructions and arrangements shown and described, since various other modifications may occur to those of ordinary skill in the art. For example, the features discussed in relation to FIG. 1 or 2 can be combined with or applicable to FIG. 3, and vice versa. The description is thus to be regarded as illustrative instead of limiting.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. A method for compressing transfer functions, comprising:

determining original transfer functions of microphones of a system, wherein each of the original transfer functions is associated with a response of one of the microphones to a sound at a location on a sphere;

determining, based on the original transfer functions, a) one or more basis transfer functions, and b) spherical harmonics coefficients that describe variations of the original transfer functions with respect to spherical coordinates.

2. The method of claim 1, wherein determining the one or more basis transfer functions includes applying a shifted component analysis to the original transfer functions to generate a) for each microphone, a set of time shifts that includes a time shift for each location on the sphere, the set of time shifts representing temporal differences between the original transfer functions, and b) for each microphone, a set of spatial weights that includes a spatial weight for each location on the sphere.

3. The method of claim 2, wherein the spherical harmonics coefficients include time shift coefficients and spatial weight coefficients that are compressed representations of the sets of time shifts and the sets of spatial weights.

4. The method of claim 3, wherein determining the spherical harmonics coefficients includes performing spherical harmonics analysis on the sets of time shifts to generate the time shift coefficients that model variation of the time shifts relative to coordinates on the sphere.

5. The method of claim 3, wherein determining the spherical harmonics coefficients includes performing spherical harmonics analysis on the sets of spatial weights to generate the spatial weight coefficients that model variation of the spatial weights relative to coordinates on the sphere.

6. The method of claim 3, further comprising for areas on the sphere where previous calculations are deemed insufficient, recalculating, based on a subset of the time shifts and the spatial weights, new time shifts and new spatial weights using component analysis, and determining, based on the new time shifts and new spatial weights, sets of recalculated spherical harmonics coefficients.

7. The method of claim 6, wherein the microphones have a complex interference pattern of HRTFs that introduce complexity at those areas on the sphere deemed insufficient.

8. The method of claim 2, wherein the shifted component analysis includes aligning the original transfer functions temporally and applying component analysis to the original transfer functions to reduce dimensions of the original transfer functions and determining a component that indicates a largest variation of the original transfer functions when aligned.

9. The method of claim 1, wherein determining the one or more basis transfer functions and spherical harmonics coefficients includes applying a shifted component analysis to the original transfer functions to generate, for each of the microphones, a set of time shifts that includes a time shift for each location on the sphere, the set of time shifts representing temporal differences between the original transfer functions;

performing spherical harmonics analysis on the sets of time shifts to generate time shift coefficients that model variation of the time shifts relative to coordinates on the sphere;

applying the time shift coefficients to the original transfer functions to align the original transfer functions temporally;

determining, based on the aligned original transfer functions, a) the one or more basis transfer functions, and b) for each of the microphones, a set of spatial weights that includes a spatial weight for each location on the sphere for each of the microphones; and performing spherical harmonics analysis on the sets of spatial weights to generate spatial weight coefficients that model variation of the spatial weights relative to coordinates on the sphere.

10. The method of claim 9, wherein determining a) the one or more basis transfer functions, and b) the set of spatial weights includes applying a principal component analysis or other basis decomposition method on the aligned transfer functions.

11. The method of claim 1, wherein the one or more basis transfer functions, and the spherical harmonics coefficients are encoded as metadata in an audio file with audio data that was recorded with the microphones.

12. The method of claim 1, wherein the one or more basis transfer functions and the spherical harmonics coefficients are associated with an audio file ora capture device.

13. The method of claim 12, wherein the one or more basis transfer functions and the spherical harmonics coefficients are communicated over a network.

14. A system, including:

a processor;

a plurality of microphones;

non-transitory computer-readable memory having stored therein instructions that when executed by the processor cause the processor to perform the following:

determining original transfer functions of the microphones, wherein each of the original transfer functions is associated with a response of one of the microphones to a sound at a location on a sphere;

determining, based on the original transfer functions, a) one or more basis transfer functions, and b) spherical harmonics coefficients that describe variations of the original transfer functions with respect to spherical coordinates.

15. The system of claim 14, wherein determining the one or more basis transfer functions includes applying a shifted component analysis to the original transfer functions to generate a) for each of the microphones, a set of time shifts that includes a time shift for each location on the, the set of time shifts representing temporal differences between the original transfer functions, and b) for each of the microphones, a set of spatial weights that includes a spatial weight for each location on the sphere.

16. The system of claim 15, wherein the spherical harmonics coefficients include time shift coefficients and spatial weight coefficients that are compressed representations of the sets of time shifts and sets of spatial weights that associate variations of the original transfer functions to coordinates on the sphere.

17. The system of claim 14, wherein determining the one or more basis transfer functions and spherical harmonics coefficients includes applying a shifted component analysis to the original transfer functions to generate, for each of the microphones, a set of time shifts that includes a time shift for each location on the sphere, the time shifts representing temporal differences between the original transfer functions;

performing spherical harmonics analysis on the sets of time shifts to generate time shift coefficients that model variation of the time shifts relative to coordinates on the sphere;

applying the time shift coefficients to the original transfer functions to align the original transfer functions temporally;

determining, based on the aligned original transfer functions, a) the one or more basis transfer functions, and b) for each of the microphones, a set of spatial weights that includes a spatial weight for each location on the sphere; and performing spherical harmonics analysis on the sets of spatial weights to generate spatial weight coefficients that model variation of the spatial weights relative to coordinates on the sphere.

18. The system of claim 14, wherein the system is a mobile phone, a tablet computer, a headphone set, a laptop computer, a head mounted display, a camera, or a loud speaker.

19. A method of processing audio, comprising:

receiving audio data, one or more basis transfer functions, and spherical harmonics coefficients that describe variations of original transfer functions of microphones of a recording device with respect to spherical coordinates;

generating an audio filter based on the one or more basis transfer functions and spherical harmonics coefficients; and applying the audio filter to the received audio data.

20. The method of claim 19, wherein the spherical harmonics coefficients include time shift coefficients and spatial weight coefficients.

21. A method for compressing transfer functions, comprising:

determining original transfer functions of a sound radiating device, wherein each of the original transfer functions is associated with a response of a microphone at a known location on an imaginary grid having a spherical geometry, relative to a sound emanated from the sound radiating device;

determining, based on the original transfer functions, a) one or more basis transfer functions, and b) spherical harmonics coefficients that describe variations of the original transfer functions with respect to spherical coordinates.

22. The method of claim 21, wherein determining the one or more basis transfer functions includes applying a shifted component analysis to the original transfer functions to generate a) for each of the microphones, a set of time shifts that includes a time shift for each location on a sphere, the time shifts representing temporal differences between the original transfer functions, and b) for each of the microphones, a set of spatial weights that includes a spatial weight for each location on the imaginary grid.

23. The method of claim 22, wherein the spherical harmonics coefficients include time shift coefficients and spatial weight coefficients that are compressed representations of the sets of time shifts and the sets of spatial weights.

24. The method of claim 23, wherein determining the spherical harmonics coefficients includes performing spherical harmonics analysis on the sets of time shifts to generate the time shift coefficients that model variation of the time shifts relative to coordinates on the sphere.

25. The method of claim 23, wherein determining the spherical harmonics coefficients includes performing spherical harmonics analysis on the sets of spatial weights to generate the spatial weight coefficients that model variation of the spatial weights relative to coordinates on the sphere.

* * * * *